US007372423B2

(12) United States Patent
Packer et al.

(10) Patent No.: US 7,372,423 B2
(45) Date of Patent: May 13, 2008

(54) RAPIDLY DEPLOYABLE ANTENNA SYSTEM

(75) Inventors: Malcolm J. Packer, Fairport, NY (US); Brent E. Raiber, Springville, NY (US); Pablo A. Diez, Fairport, NY (US)

(73) Assignee: Harris Corporation, Melbourne, FL (US)

( * ) Notice: Subject to any disclaimer, the term of this patent is extended or adjusted under 35 U.S.C. 154(b) by 45 days.

(21) Appl. No.: 11/550,129

(22) Filed: Oct. 17, 2006

(65) Prior Publication Data

US 2008/0088523 A1 Apr. 17, 2008

(51) Int. Cl.
*H01Q 11/10* (2006.01)

(52) U.S. Cl. ..... 343/792.5; 343/793; 343/915

(58) Field of Classification Search ..... 343/792.5, 343/793, 915; 342/8, 10
See application file for complete search history.

(56) References Cited

U.S. PATENT DOCUMENTS

| | | | | |
|---|---|---|---|---|
| 3,715,759 | A * | 2/1973 | Esposito et al. | 343/792.5 |
| 6,154,180 | A | 11/2000 | Padrick | |
| 6,326,932 | B1 | 12/2001 | Mannan | |
| 6,360,760 | B1 | 3/2002 | Louie et al. | |
| 6,952,189 | B2 * | 10/2005 | Engargiola et al. | 343/792.5 |
| 7,133,001 | B2 * | 11/2006 | Mrstik et al. | 343/915 |
| 2007/0103376 | A1 * | 5/2007 | Goldberg et al. | 343/792.5 |

* cited by examiner

*Primary Examiner*—Tan Ho
(74) *Attorney, Agent, or Firm*—GrayRobinson, PA

(57) ABSTRACT

An antenna system is provided including a rapidly expandable-collapsible housing which mounts two sections of fabric material each having an array of antenna elements formed of electrically conductive material such as copper thread embedded in the fabric sections. The fabric sections are movable between the expanded and collapsed positions with the housing and are located in different planes.

20 Claims, 2 Drawing Sheets

FIG. 3
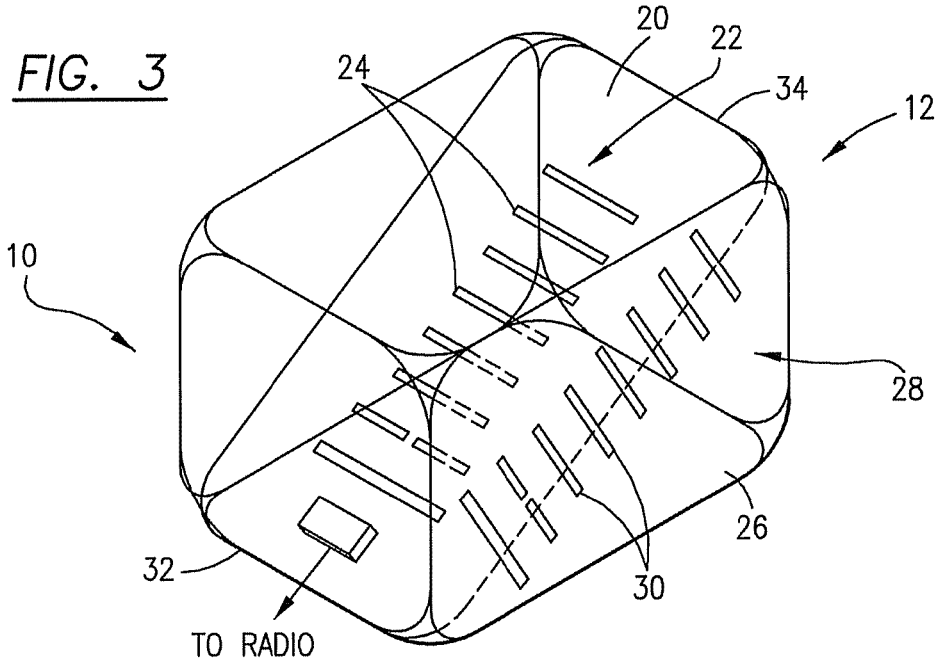
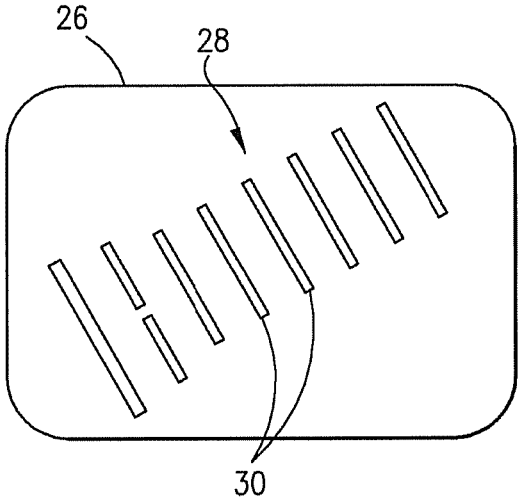
FIG. 4
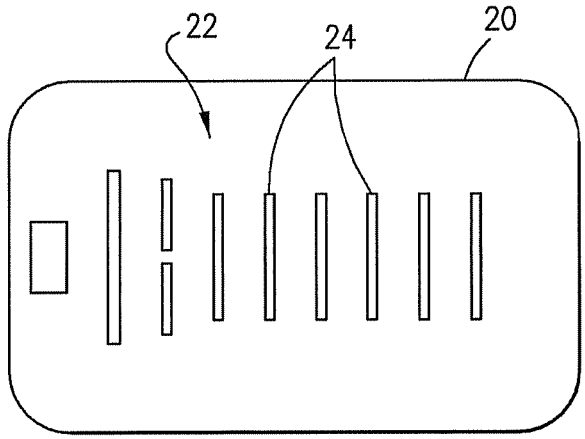
FIG. 5

RAPIDLY DEPLOYABLE ANTENNA SYSTEM

FIELD OF THE INVENTION

This invention relates to tactical satellite communication (TACSAT) antennas, and, more particularly, to a TACSAT antenna which is housed within an expandable/collapsible frame so that the antenna can be rapidly deployed, and rapidly stowed in seconds into a small volume and manufactured at reduced cost compared to existing designs.

BACKGROUND OF THE INVENTION

Satellite radios employ an antenna to transmit and receive signals, and require high gain to communicate with geosynchronous satellites. A number of antennas have been developed in the past for satellite radios but most are relatively large and bulky, they must be unloaded from a container, backpack or the like and then assembled for use. Conventionally, it takes tens of minutes to deploy a TACSAT antenna, and it is not unusual for a soldier or other operator of a satellite radio to begin using it before the antenna is fully assembled. In many military operations and other situations, time is of the essence and it is highly desirable to substantially reduce the time required to deploy, and more so to stow, the antenna.

As noted above, the stowed size of typical TACSAT antennas is large and bulky. Efforts to reduce the stowed size have typically resulted in decreased gain of the antenna which, in turn, degrades performance of the satellite communications link. Additionally, the smaller the stowed size of the antenna, the higher its cost. It is not unusual for TACSAT antennas to be priced at several thousand dollars per unit, while still suffering from problems of large stowed size and insufficient gain.

SUMMARY OF THE INVENTION

This invention is directed to a TACSAT antenna system which may be rapidly deployed, exhibits high gain, rapidly stowed into a small, compact size and can be manufactured at low cost.

The antenna system of this invention includes a "twist and fold" type of self-deployable housing having stiff frame elements which are interconnected by sections of fabric to form a hollow interior. The housing is movable between a deployed or expanded position and a stowed or collapsed position in which it occupies a very compact space.

In the presently preferred embodiment, the circular polarized antenna is embodied by a vertically polarized Yagi-Uda array and a horizontally polarized Yagi-Uda array mounted on separate support structures to the housing. Each support structure preferably takes the form of a section of fabric or similar material, and the dipole elements of the arrays are formed of electrically conductive material such as copper thread embedded in the fabric sections. The fabric sections with arrays are movable between the expanded and collapsed positions with the housing, and are located in different planes so that the arrays they carry create circular polarization. The arrays may be connected by a hybrid balun and coaxial cable to a TACSAT radio.

BRIEF DESCRIPTION OF THE DRAWINGS

The structure, operation and advantages of the presently preferred embodiment of this invention will become further apparent upon consideration of the following description, taken in conjunction with the accompanying drawings, wherein:

FIG. 3 is a view of the housing of FIG. 1 in a deployed position, without the fabric which holds the stiff frame elements together, wherein first and second support structures each carrying dipole elements are schematically depicted;

FIG. 4 is an enlarged view of one support structure shown in FIG. 3 having a horizontally polarized Yagi-Uda array embedded therein; and FIG. 5 is an enlarged view of the other support structure shown in FIG. 3 having a vertically polarized Yagi-Uda array embedded therein.

DETAILED DESCRIPTION OF THE INVENTION

Figure 1:
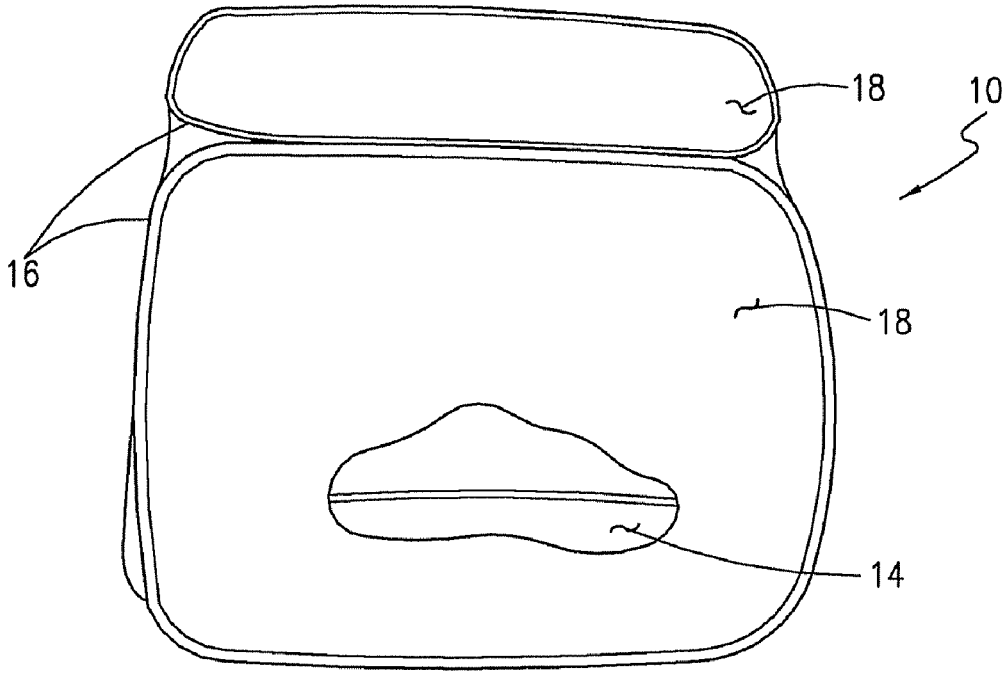
FIG. 1 is a perspective view of the housing of this invention in the deployed or expanded position.
Figure 2:
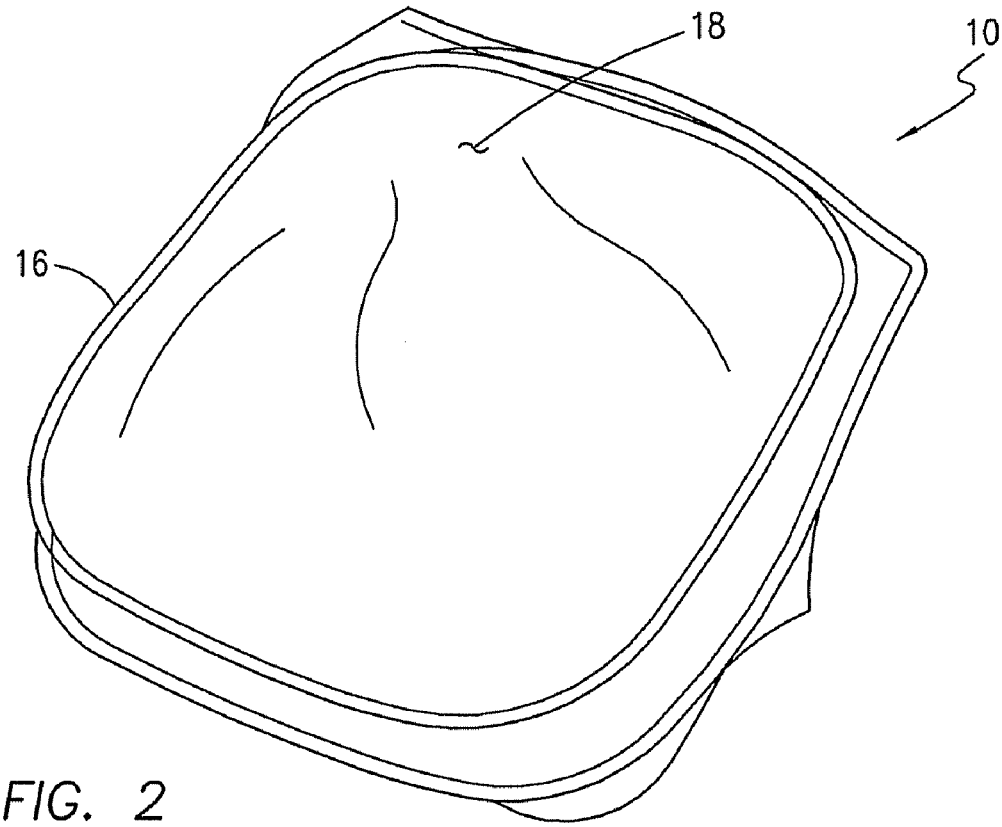
FIG. 2 is a view of the housing of FIG. 1 in the collapsed or stowed position.

Referring initially to FIGS. 1 and 2, a housing 10 is depicted for mounting the TACSAT antenna 12 of this invention. The housing 10 is a "twist and turn" type of expandable-collapsible structure, and, in the form shown, expands to a generally square configuration having a hollow interior 14 as depicted in FIG. 1. The detailed construction of the housing 10 forms no part of this invention, and is therefore not described in detail herein. For purposes of the present discussion, the housing 10 includes a number of stiff frame elements 16 connected by panels 18 of fabric material such as nylon or other suitable fabric which is light-weight, weather-resistant and durable. In order to expand the housing 10, one merely grasps and twists a couple of frame elements 16 and their resiliency causes the housing 10 to assume the position shown in FIG. 1. Similarly, the housing 10 may be easily collapsed to the position illustrated in FIG. 2 by the same twisting motion of the frame elements 16. It should be understood that while the housing 10 is illustrated as having a generally square-shape in FIGS. 1 and 2, other shapes may be suitable for use in the present invention so long as they can be expanded and collapsed with a simple twisting motion, or the like, as noted above.

With reference to FIGS. 3-5, the antenna 12 of this invention comprises first and second support structures in the form of a first section 20 of fabric material having a first array 22 of dipole elements 24, and a second section 26 of fabric material having a second array 28 of dipole elements 30. It is contemplated that the fabric material forming first and second sections 20 and 26 could be any weather-resistant, durable and light-weight synthetic or natural material, including nylon or the like. For ease of illustration, the panels 18 and frame elements 16 of housing 10 are eliminated from FIG. 3.

Considering initially the mounting of first and second sections 20 and 26 to the housing 10, and their relative positioning, the first section 20 of fabric material is preferably located within the hollow interior 14 of the housing 10. A lower edge 32 of the first section 20 of fabric material is affixed to a lower end of the base of housing 10, and it extends upwardly at an angle of approximately 450 relative to vertical. The opposite, upper edge 34 of first section 20 of fabric material is affixed to the top end of the housing 10, as shown. The second section 26 of fabric material is mounted to one side of the housing 10 at an angle of approximately 90° relative to the first section 20 and in a different plane. The "plane" in which the first section 20 is mounted extends along approximately a 45° angle from the bottom to the top of the housing 10 in its expanded position, whereas the second section 26 is located in a "plane" defined by one side of the housing 10 in the expanded position, as shown in FIG. 3. The first and second sections 20 and 26 of fabric material may be affixed to the panels 18 or to the stiff frame elements 16 of the housing 10, or both. In any case, the first and second sections 20 and 26 of fabric material assume the expanded shape of the housing 10 depicted in FIG. 1, and its collapsed shape shown in FIG. 2, so that the antenna 12 may be rapidly deployed, and rapidly stowed in a compact, collapsed position, essentially as part of the housing 10.

As noted above, the first section 20 of fabric material is provided with a first array 22 of dipole elements 24. In the presently preferred embodiment, the dipole elements 24 form a vertically polarized Yagi-Uda array although other dipole arrays may be employed. Each of the dipole elements 24 is preferably formed of an electrically conductive material, such as copper thread, which is embedded in the fabric material of the first section 20. The dipole elements 30 of the second section 26 of fabric material form a horizontally polarized Yagi-Uda array, although, like the first array 20, other dipole arrays may be employed. Each of the dipole elements 24 is preferably formed of an electrically conductive material, such as copper thread, which is embedded in the fabric material of the second section 26. It is contemplated that other electrically conductive materials may be used to form the dipole elements 24 and 30, and other means of affixing such materials could be employed, so long as such material is fixed in placed and movable with the first and second sections 20, 26, respectively, in response to the expansion and collapse of the housing 10.

As shown in FIG. 3, the dipole elements 24 and 30 are disposed in different planes which creates circular polarization. Further, the antenna 12 has a hybrid splitter since there is a 90° phase shift between the dipole elements 24 and 30. In the illustrated embodiment, the first section 20 of fabric material carrying dipole elements 24 is oriented at an angle of about 45° to vertical, and the dipole elements 30 extend at that same angle along the second section 26 of fabric material. Hence, the antenna 12 has a fixed take-off angle of approximately 45°. It is contemplated that such take-off angle could be altered, as desired, and the angle shown is for purposes of illustration only.

As schematically depicted in FIG. 3, the antenna 12 may be connected to essentially any type of TACSAT radio, including handheld, pack or the like, via a BNC (Bayonet Neill Connector) and a coaxial cable (not shown).

The housing 10 and antenna 12 of this invention collectively form a rapidly deployable antenna system which is light-weight, inexpensive to manufacture, occupies minimal space in the collapsed position and is easily manipulated between the collapsed and expanded positions with minimal time and effort. The antenna 12 provides high gain, circular polarization to combat fading, and may be employed with essentially any type of TACSAT radio.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An antenna system, comprising:

a housing movable between an expanded position and a collapsed position, said housing having a hollow interior;

a first support structure mounted to said housing and a second support structure mounted to said housing in a different plane from said first support structure, each of said first and second support structures being movable with said housing between said expanded and collapsed positions;

a first array of dipole elements affixed to said first support structure and a second array of dipole elements affixed to said second support structure, said dipole elements being adapted to connect to a radio.

2. The antenna system of claim 1 in which said housing is a twist and fold structure having a number of stiff frame elements connected by panels of a fabric material.

3. The antenna system of claim 1 in which said first support structure is a first section of fabric material.

4. The antenna system of claim 3 in which said first array of dipole elements is formed of electrically conductive material embedded in said first section of fabric material.

5. The antenna system of claim 3 in which said first array of dipole elements is a vertically polarized Yagi-Uda array.

6. The antenna system of claim 3 in which said first support structure is oriented at an angle of about 45° relative to vertical with said housing in said expanded positions.

7. The antenna system of claim 1 in which said second support structure is a second section of fabric material.

8. The antenna system of claim 7 in which said second array of dipole elements is formed of electrically conductive thread embedded in said second section of fabric material.

9. The antenna system of claim 7 in which said second array of dipole elements is a horizontally polarized Yagi-Uda array.

10. The antenna system of claim 7 in which said second support structure is oriented at an angle of about 90° relative to said first support structure.

11. The antenna system of claim 1 in which at least one of said first and second support structures is located within said hollow interior of said housing.

12. An antenna system, comprising:

a housing movable between an expanded position and a collapsed position, said housing having a hollow interior;

a first section of fabric material mounted to said housing and movable between said expanded and collapsed positions with said housing;

a first array of dipole elements, said dipole elements of said first array being formed of electrically conductive material embedded within said first section of fabric material and being adapted to connect to a radio;

a second section of fabric material mounted to said housing in a different plane from said first section of fabric material, said second section of fabric material being movable between said expanded and collapsed positions with said housing;

a second array of dipole elements, said dipole elements of said second array being formed of an electrically conductive material embedded within said second section of fabric material and being adapted to connect to the radio.

13. The antenna system of claim 12 in which circular polarization is created by said first and second arrays of dipole elements.

14. The antenna system of claim 12 in which said housing is a twist and fold structure having a number of stiff frame elements connected by panels of a fabric material.

15. The antenna system of claim 12 in which said first array of dipole elements is a vertically polarized Yagi-Uda array.

16. The antenna system of claim 12 in which said second array of dipole elements is a horizontally polarized Yagi-Uda array.

17. The antenna system of claim 12 in which said second section of fabric material is oriented at an angle of about 90° relative to said first section of fabric material.

18. The antenna system of claim 17 in which said first and second arrays collectively form a circularized polarized antenna with a hybrid splitter.

19. The antenna system of claim 12 in which at least one of said first and second sections of fabric material is located within said hollow interior of said housing.

20. The antenna system of claim 12 in which said electrically conductive material forming said dipole elements of said first and second arrays is electrically conductive thread.

* * * * *